US005984710A

United States Patent [19]

Kodama

[11] Patent Number: 5,984,710

[45] Date of Patent: Nov. 16, 1999

[54] SHIELDED WIRE TERMINATING STRUCTURE

[75] Inventor: Shinji Kodama, Shizuoka-ken, Japan

[73] Assignee: Yazaki Corporation, Tokyo, Japan

[21] Appl. No.: 08/933,040

[22] Filed: Sep. 18, 1997

[30] Foreign Application Priority Data

Sep. 18, 1996 [JP] Japan ..... 8-246483

[51] Int. Cl.[6] ..... H01R 4/24

[52] U.S. Cl. ..... 439/394; 439/581; 439/610

[58] Field of Search ..... 439/393, 394, 439/581, 610

[56] References Cited

U.S. PATENT DOCUMENTS

| | | | |
|---|---|---|---|
| 3,744,007 | 7/1973 | Horak | 439/394 |
| 4,408,822 | 10/1983 | Nikitas | 439/394 |
| 4,708,414 | 11/1987 | Lam | 439/394 |

*Primary Examiner*—Hien Vu

*Attorney, Agent, or Firm*—Oblon, Spivak, McClelland, Maier & Neustadt, P.C.

[57] ABSTRACT

A core wire is terminated at a terminal accommodatable in a connector housing, and a non-stripped part of a shielded wire including a cover is cut by a blade fixed in the connector housing into a depth allowing a conductive contact of the blade with a braid, whereby the braid is terminated to another terminal having the blade as its integral part.

5 Claims, 6 Drawing Sheets

SHIELDED WIRE TERMINATING STRUCTURE

BACKGROUND OF THE INVENTION

1. Field of the Invention

The present invention generally relates to a shielded wire terminating structure, and particularly, it relates to a structure for terminating an electromagnetically shielded wire having a conductive braid provided around a core wire with an intervenient insulator.

2. Description of Relevant Art

There has been disclosed in JITUKAIHEI (Japanese Utility Model Application Laid-Open Publication No.) 2-97766 a shielded wire with solderless terminals shown in FIGS. 1A and 1B. Designated at reference character 1 is the shielded wire, and 7, 8 and 11 are the terminals. The shielded wire 1 has a pair of core wires 2, 3 as signal lines, a braid 4 as a set of braided shielding wires surrounding the core wires 2, 3 with an intervenient insulator, and an insulating cover 5 for covering the braid 4.

FIG. 2 shows the shielded wire 1 terminating at a connector 6. For the termination, the core wires 2, 3 have their terminal parts stripped and applied with the terminals 7, 8 at the ends, respectively. The braided shielding wires 4 have their terminal parts stripped to be exposed with a relatively short length and collected into a short bundle, which is connected at its free end to one end of an additional wire 9 by a pressed interconnection sleeve as a repeating terminal 10. The other end of the wire 9 has the terminal 11 applied thereto. Then, an exposed part of the wire bundle 4 is folded back on a remaining end of the cover 5, and a noise shielding tubular member 12 is applied thereon, covering lead-out parts of the core wires 2, 3, arranging ends of the terminals 7, 8 and 11 at a distance. Thereafter, the terminals 7, 8 and 11 are inserted into appropriate accommodation chambers 13 of the connector 6. Briefly, a shielded wire 1 is terminated by applying metallic terminals 7, 8 and 11 to terminal parts of core wires 2, 3 and braided wires 4 thereof, respectively, and the terminals 7, 8 and 11 are respectively inserted to be accommodated in a connector 6 for an extended connection of the wire terminal parts.

Such the termination is troublesome, as terminal parts of braided wires 4 are stripped to be exposed and collected in a bundle which is connected with a repeating terminal 10 pressed flat. The solderless terminal 11 is inadaptive for a direct application to the bundle of wires 4. The short bundle 4 is interconnected with the terminal 11 by the provision of an additional wire 9 of which both ends need to be terminated, resulting in an increased number of steps of termination work.

SUMMARY OF THE INVENTION

The present invention has been achieved with such points in view.

It therefore is an object of the present invention to provide a shielded wire terminating structure permitting a facilitated termination.

To achieve the object, an aspect of the present invention provides a structure for terminating a shielded wire at a concerned connector having a mating connector, the shielded wire including a core wire, an insulator on the core wire, a braid on the insulator, and a cover on the braid, the mating connector including a mating housing and a first mating terminal accommodated in the mating housing, the structure comprising a connector housing of the concerned connector engageable with the mating housing, the connector housing being formed with a chamber, a first terminal member applied to the core wire, the first terminal member being accommodatable in the chamber for engagement with the first mating terminal, and a second terminal member having a blade disposed in the connector housing for cutting the cover, as it is introduced in the housing along with accommodation of the first terminal member, to conductively contact with the braid.

According to the first aspect, a shielded wire is stripped to have a core wire exposed. A first terminal member is applied to a terminal part of the exposed core wire in a known manner. Then, the first terminal member is accommodated in a chamber of a connector housing. On the way of accommodation, a non-stripped part of the shielded wire including a cover is forced into the connector housing, where it is cut by a blade of a second terminal member into a depth allowing for a conductive contact of the blade with a braid of the shielded wire. Then, the connector housing is engaged with a mating housing, causing the first terminal member to be engaged with a mating terminal.

Accordingly, the braid is not required to be exposed and collected into a bundle for termination, permitting a facilitated termination of the shielded wire.

According to a second aspect of the invention which depends from the first aspect, the mating connector includes a second mating terminal disposed in the mating housing, and the second terminal member is engageable with the second mating terminal.

According to the second aspect, a second terminal member also is engaged with a mating terminal when a connector housing is engaged with a mating housing, with a reduced number of working steps.

According to a third aspect of the invention which depends from the second aspect, the second terminal member has a plurality of the blades axisymmetrically arranged.

According to the third aspect, a non-stripped part of a shielded wire is axisymmetrically cut, permitting an axisymmetrical contact with a braid under an equalized contact pressure, allowing a secured connection.

According to a fourth aspect of the invention which depends from the third aspect, the second terminal member comprises a first conductive portion having an opening provided therethrough and defined by a circular wall formed with the blades, and a second conductive portion extending from the first conductive portion for engagement with the second mating terminal.

According to the fourth aspect, a first conductive portion of a second terminal member is permitted to be fixed at an entrance of a connector housing, without a possibility of interfering with a first terminal member, with a secured accuracy permitting a smooth mating.

According to a fifth aspect of the invention which depends from the fourth aspect, the connector housing has a hood portion, and the second conductive portion extends alongside an inner wall of the hood portion.

According to the fifth aspect, a second conductive portion of a second terminal member is permitted to be fitted in a connector housing, without a possibility of interfering with a first terminal member, with an increased accuracy permitting a facilitated mating.

BRIEF DESCRIPTION OF THE ACCOMPANYING DRAWINGS

The above and further objects and novel features of the present invention will more fully appear from the following detailed description when the same is read in conjunction with the accompanying drawings, in which.

DETAILED DESCRIPTION OF THE PREFERRED EMBODIMENTS

Figure 1A:
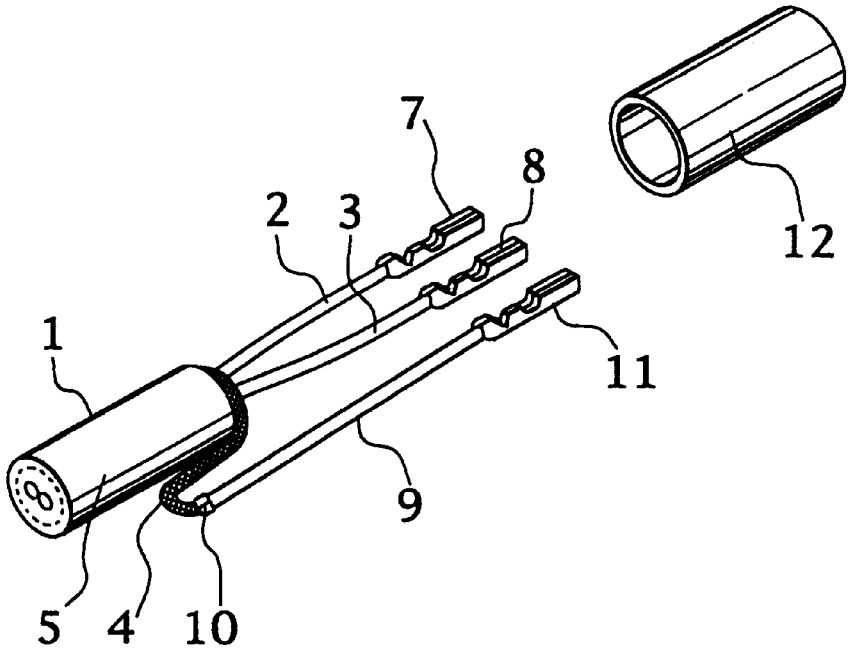
FIG. 1A PRIOR ART
FIG. 1A is a perspective view of a conventional shielded wire terminating structure before application of a cylindrical member.
Figure 1B:
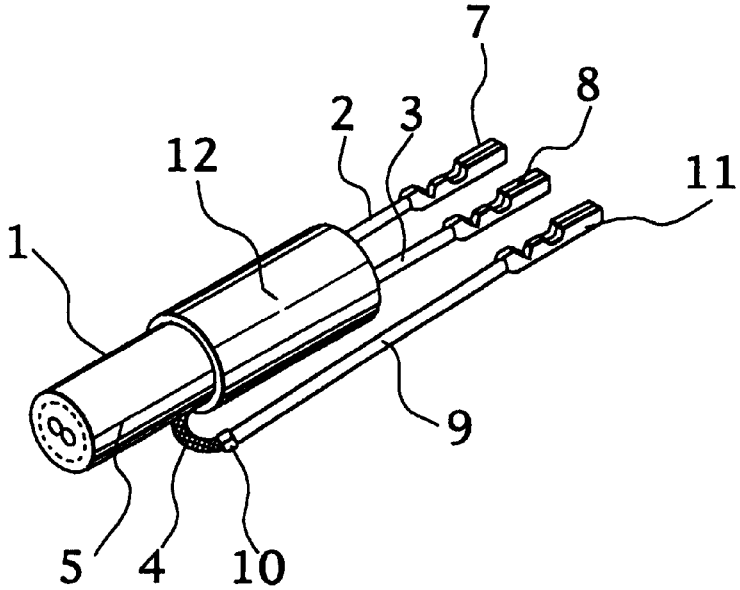
FIG. 1B PRIOR ART
FIG. 1B is a perpsective view of the conventional. structure of FIG. 1A with the cylinderical member applied.
Figure 2:
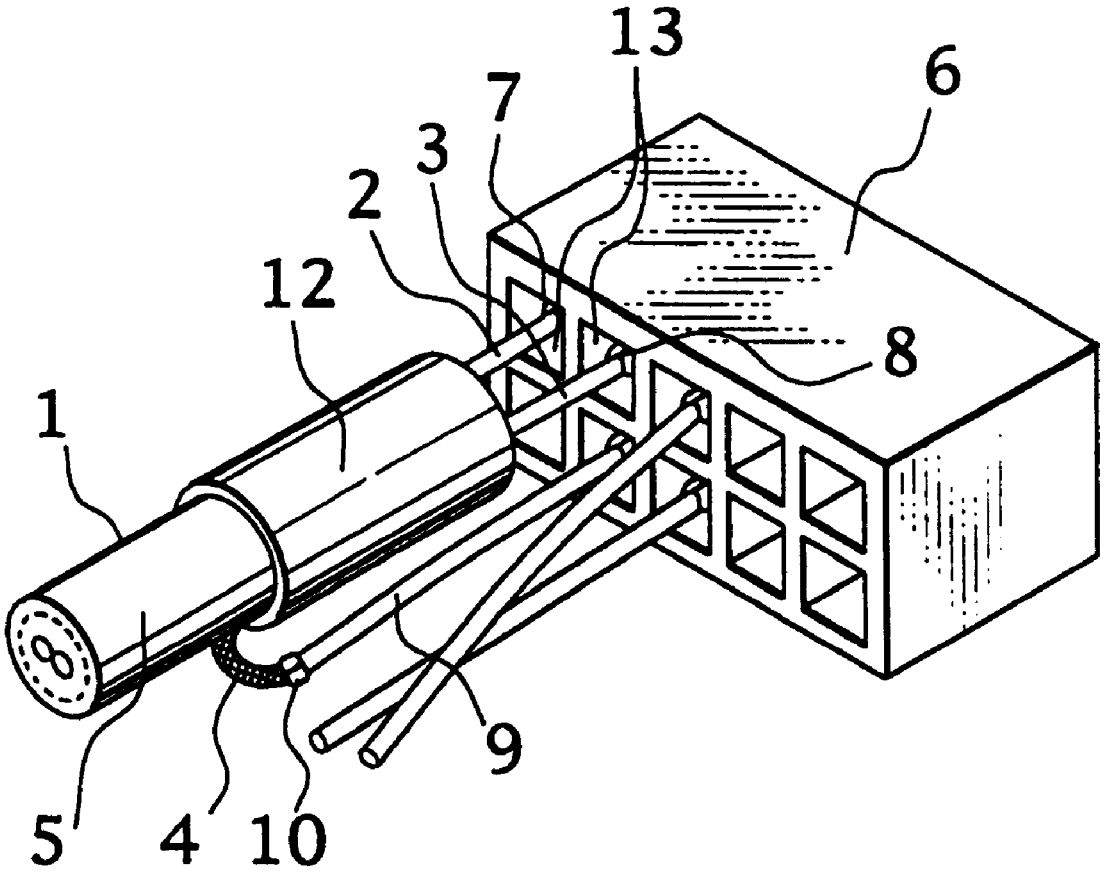
FIG. 2 PRIOR ART
FIG. 2 is a perspective view of an entirety of the conventional structure.

There will be detailed below the preferred embodiments of the present invention with reference to FIGS. 3 to 7. Like members are designated by like reference characters.

Figure 3:
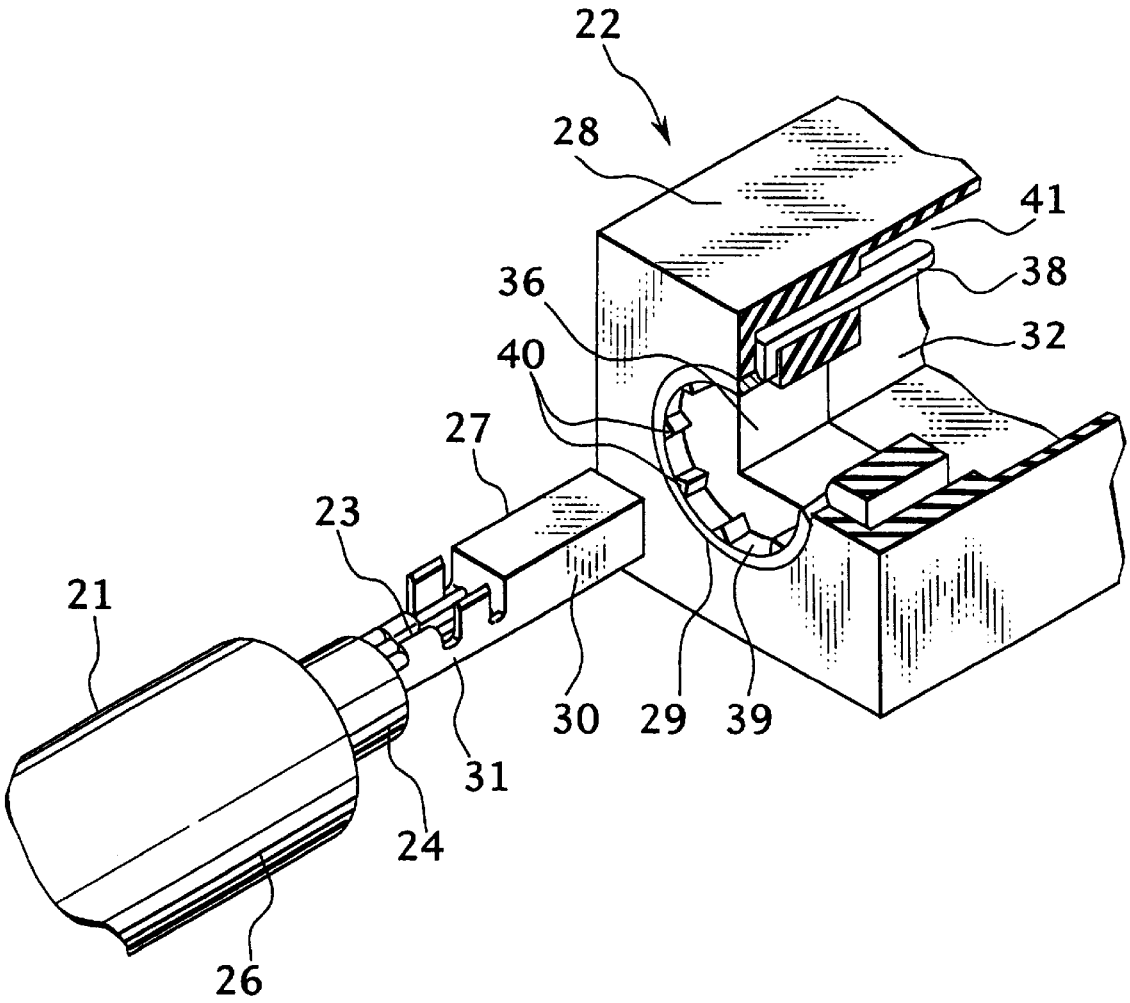
FIG. 3 is a partially cut-away perspective view of a shielded wire terminating structure according to an embodiment of the invention, in which a shielded wire has a non-stripped part.
Figure 4:
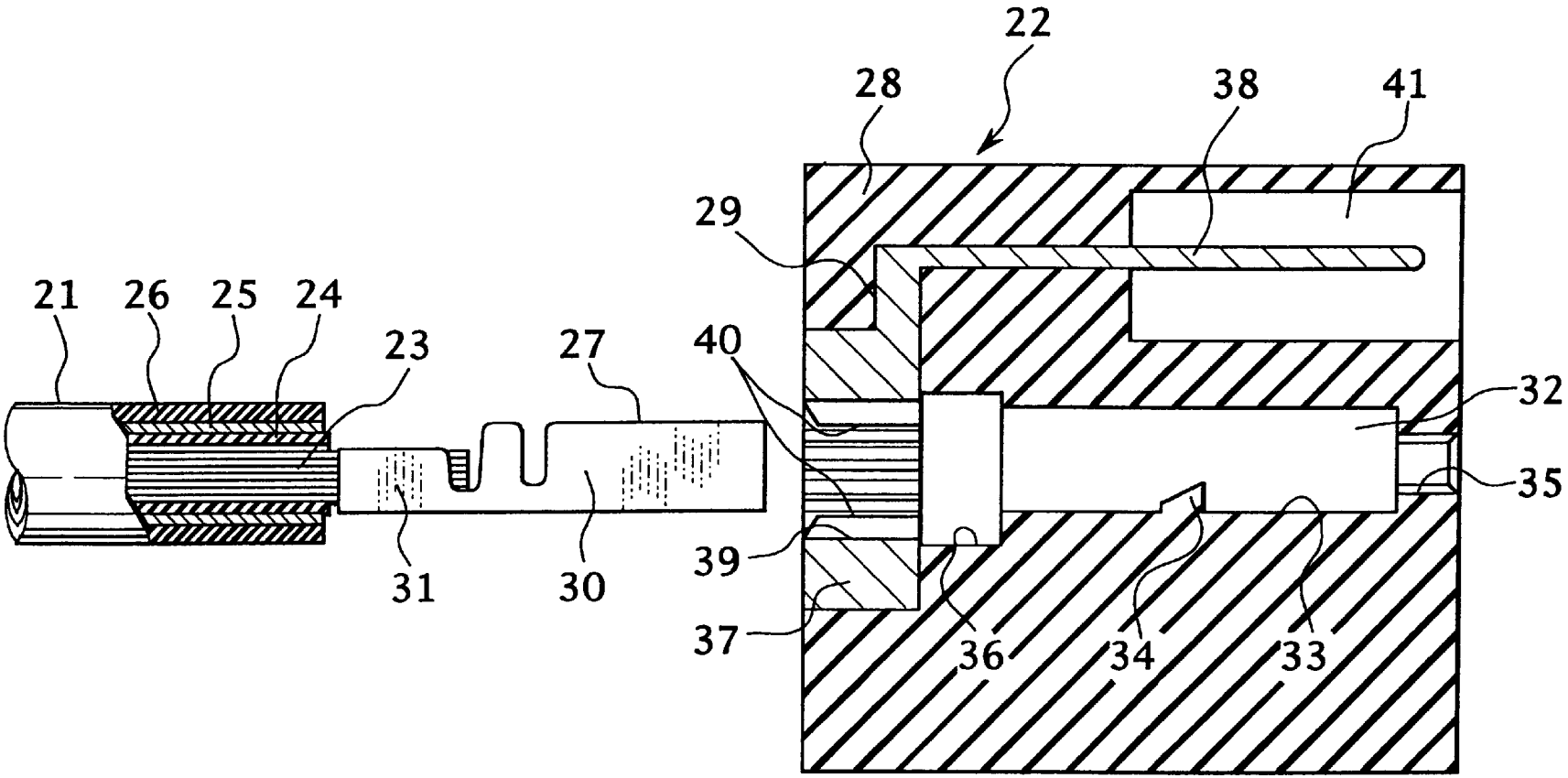
FIG. 4 is a longitudinal section of the structure of FIG. 3, in which the non-stripped part is located in ahead of a connector housing.
Figure 5:
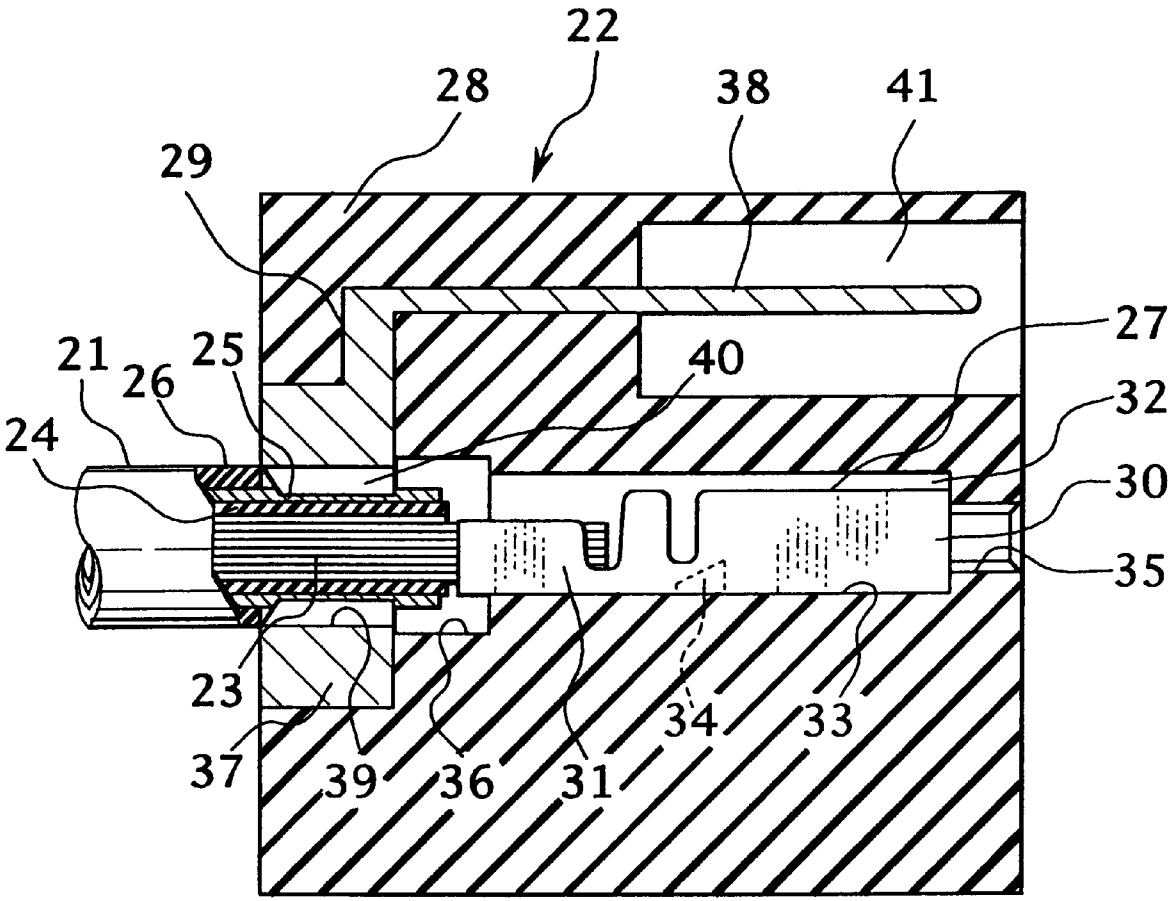
FIG. 5 is an enlarged sectional view of an essential part of the structure of FIG. 3, in which the non-stripped part is inserted in the connector housing.

FIG. 3 shows a shielded wire terminating structure according to an embodiment of the invention. FIG. 4 is a section of the structure, and FIG. 5, a detail. In the figures, desiganted by reference character 21 is a shielded wire, and 22 is a connector.

The shielded wire 1 comprises a core wire 23 consisting of a plurality of element conductors of an even diameter, a sheet of insulator 24 wrapping the core wire 23, a braid 25 consisting of a plurality of braided conductive elements surrounding the insulator 24, and an insulating cover 26 covering the braid 25.

Figure 6:
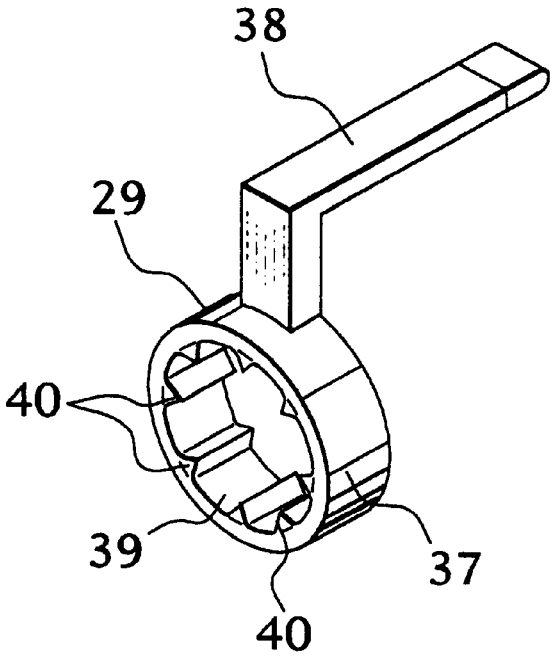
FIG. 6 is a perspective view of a braid terminating terminal of the structure of FIG. 3.
Figure 7:
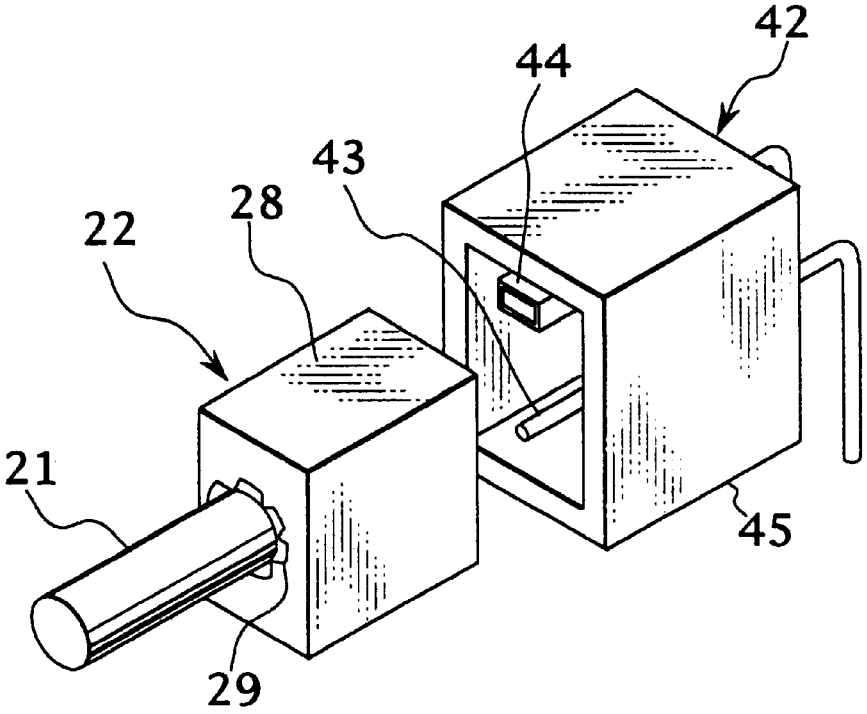
FIG. 7 is a schematic perspective view of the structure of FIG. 3 and a mating connector.

The shielded wire 1 is terminated with a structure including: a sloderless terminal 27, where the core wire 23 is terminated for a signal connection; a housing 28 of the connector 22 formed with a chamber 32 for accommodating the terminal 27 inserted to be locked therein; and a braid terminating terminal 29 fitted in the connector housing 28 for a ground connection. An entirety of this terminal 29 is shown in FIG. 6. The terminal 29 has a total of eight axisymmetrically arranged contact blades 40 as integral parts thereof. The blades 40 longitudinally cut a nonstripped part of the shield wire 21, as it is forced into the connector housing 28, and are brought into a conductive contact with the braid 25.

The solderless terminal 27 is made of a conductive flat sheet punched out and folded in a form including an electric contact portion 30 and a wire clamp portion 31. The contact portion 30 may have small contact pieces crimped to contact with element conductors of the core wire 23, and large contact pieces shaped to be engaged as in FIG. 7 with a mating terminal 43 accommodated in a housing 45 of a mating connector 42. The terminal 27 is applied to a terminal part of the shielded wire 21 of which the cover 26, braid 25 and insulator 24 have been cut away in advance, leaving the core wire 23 exposed. The exposed core wire 23 is clamped with the clamp portion 31 of the terminal 27. Such the terminal 27 is inserted from ahead of the connector housing 28 into the accommodation chamber 32.

In the housing 28, the accommodation chamber 32 has a pair of rear and front openings 35, 36 communicating therewith. The front and rear openings 35, 36 constitute a recessed entrance for the solderless terminal 27 and an entrance for the mating terminal 43, respectively. The rear opening 35 has a smaller diameter than the chamber 32 which has a smaller diameter than the front opening 36. The chamber 32 has a projection 34 formed on a wall thereof for a locking engagement with the terminal 27 to thereby prevent the terminal 27 from slipping out. The connector housing 28 has a hood portion 41 constituted with: an extension wall of a housing body part; and a rear insertion space defined by the extension wall for receiving a mating terminal 44 inserted thereto from behind the housing 28. The housing 28 further has a fitting space formed therein for fitting the braid terminating terminal 29. The fitting space has a cylindrical zone directly communicating with the front opening 36, and a leading zone communicating with the rear insertion space. The fitting space has the braid terminating terminal 29 accommodated to be fixed therein.

This terminal 29 comprises a relatively short tubular portion 37, and a relatively long terminal portion 38 extending from an outside of the tubular portion 37 first upwardly and then rearwardly. The tubular portion 37 has a cylindrical inside formed with the contact blades 40 at a pitch. The cylindrical inside has a slightly larger diameter than an outside of the shielded wire 21. The blades 40 project toward an axial centerline of the cylindrical inside, to have a sufficient height to longitudinally cut the cover 26, gaining a conductive contact with the braid 25, when the non-stripped part of the shielded wire 21 is forced into the tubular portion 37 concentrically with respect to the axial centerline. Each blade 40 is tapered at its front end, permitting a smooth cut-in. The tubular portion 37 is fitted in the tubular zone of the fitting space formed in the connector housing 28 so that the cylindrical inside is coaxial to the front opening 36 of the accommodation chamber 32. The terminal portion 38 is fitted in the leading zone of the fitting space and projects inside the rear insertion space of the hood portion 41.

There will be described a terminating procedure of the shielded wire 21. First, as shown in FIG. 4, a terminal part of the shielded wire 21 has the core wire 23 stripped to be exposed by cutting the rest. A terminal part of the exposed core wire 23 is clamped by the solderless terminal 27, and connected thereto. This terminal 27 is let through the tubular portion 37 of the braid terminating terminal 29, and inserted in the accommodation chamber 32.

On the way of this insertion, the blades 40 cut the cover 26 of the shielded wire 21, directly contacting the braid 25 in a conductive manner. When the solderless terminal 27 is inserted in the chamber 32 to an end, the projection 34 engages with the terminal 27, thereby locking to keep the same against a slip-out. The braid terminating terminal 29 is wholly conductive so that the braid 25 is electrically connected to the terminal portion 38 through the blades 40 and a body of the tubular portion 37. The shielded wire 21 is thus terminated.

Then, the connector housing 28 is fitted in the housing 45 (hood-shaped in the embodiment) of the mating connector 42*a*, causing the terminals 27, 29 to be engaged with the mating terminals 43, 44, respectively.

According to the embodiment, the braid 25 is connected to a terminal 29 simply by an insertion of another terminal 27 applied to the core wire 23. Accordingly, the braid 25 is not required to be exposed and collected into a bundle for termination, permitting a facilitated termination of the shielded wire 21.

As a conventional additional wire needing a clamping at both ends is eliminated, there is achieved a reduced number of working steps, permitting a facilitated termination of the shielded wire 21.

As the blades 40 are axisymmetrically arranged, a non-stripped part of the shielded wire 21 is axisymmetrically cut, permitting an axisymmetrical contact with the braid 25 under an equalized contact pressure, allowing a secured connection.

In the embodiment, the terminal portion 38 of the braid terminating terminal 29 is a male type. The terminal portion 38 may preferably be a female type.

The invention is applicable also to a shielded wire with a plurality of core wires. A solderless terminal may be applied to a respective core wire. A non-stripped part of the shielded wire may be forced into a tubular portion of a braid terminating terminal, where a cover may be cut by blades, causing a braid to contact with the blades.

While preferred embodiments of the present invention have been described using specific terms, such description is for illustrative purposes, and it is to be understood that changes and variations may be made without departing from the spirit or scope of the following claims.

What is claimed is:

1. An electrical connector for connecting a shielded wire and engaging a mating connector, the shielded wire including a core wire, an insulator on the core wire, a braid on the insulator, and a cover on the braid, the mating connector including a mating housing and a first mating terminal housed in the mating housing, the electrical connector comprising:

a connector housing configured to engage the mating housing of the mating connector, the connector housing having a chamber therein;

a first terminal member fitted in the connector housing, for a grounding connection, having a fixed aperture and a first conductive portion forming an annular wall around the fixed aperture to receive the shielded wire, said annular wall including at least one stationary blade; and a second terminal member connected to the core wire and slidable within the chamber of the connector housing, said second terminal member being configured to engage the first mating terminal of the mating connector, said stationary blade being configured to cut the cover of the shielded wire and contact the braid as the second terminal member is slid within the connector housing along the first terminal member to conductively contact the braid.

2. An electrical connector according to claim 1, wherein the mating connector comprises:

a second mating terminal disposed in the mating housing and configured to engage the first terminal member.

3. An electrical connector according to claim 2, wherein the annular wall comprises:

plural stationary blades symmetrically and radially arranged around the fixed aperture.

4. An electrical connector according to claim 3, wherein the first terminal member comprises:

a second conductive portion extending from the first conductive portion and configured to engage the second mating terminal, said plural stationary blades being arranged around an inner surface of said annular wall.

5. An electrical connector according to claim 4, wherein the connector housing comprises;

a hood portion having all inner wall, the second conductive portion extending along the inner wall of the hood portion.

* * * * *